United States Patent [19]

Testa, Jr.

[11] Patent Number: 4,896,703

[45] Date of Patent: Jan. 30, 1990

[54] DEVICE FOR FORMING HANGWIRES

[76] Inventor: Vincent M. Testa, Jr., P.O. Box 501, Beverly, Mass. 01915

[21] Appl. No.: 244,353

[22] Filed: Sep. 15, 1988

[51] Int. Cl.[4] ..... B21F 1/06

[52] U.S. Cl. ..... 140/104

[58] Field of Search ..... 140/51, 73, 104, 115, 140/119, 122, 149, 118; 269/91, 94, 126, 127, 128, 135

[56] References Cited

U.S. PATENT DOCUMENTS

| | | | |
|---|---|---|---|
| 396,651 | 1/1889 | Franco | 140/73 |
| 740,444 | 10/1903 | Lamb et al. | 140/104 |
| 869,006 | 10/1907 | Merkel | 140/73 |
| 1,251,193 | 12/1917 | Dunn . | |
| 1,307,409 | 6/1919 | Matthews | 140/73 |
| 2,443,564 | 6/1948 | Kunkle et al. | 140/104 |

*Primary Examiner*—Lowell A. Larson

[57] ABSTRACT

A device for twisting a conventional J-shaped wire preform into a hangwire has a rotatable hook by which the closed end of a preform is held and a wall spaced therefrom has an upwardly opening slot in alignment with the hook axis and overlying a ledge. The slot is spaced from the hook a distance such that both arms of the preform can be entered and then held against turning by a hold down arm. The hook is rotated by a gear train provided with a crank with the gear train providing mechanical advantage to the user and enabling the length of the crank arm to be less than the distance between its axis and the base of the device. The hold down arm has a first inoperative position in which it depends vertically, its position when the device is shipped or stored, and a second position for use during hangwire production in which position the arm is held upwardly but tilted away from the slot.

5 Claims, 2 Drawing Sheets

10
11
11A
12
13A
13B
15
15A
16
17
18
19
20
23
25
25A
25B
26
27
28
29
30
31

10
11
11A
12
13A
13B
14
17
18
19
20
21
22
23
24
26
27
28
29
31

12
13A
13B
13
14A
29'
11A
11
17
20
23
29A
30
31
27
18
29
29B
28
19
26
10
29"
15A
16
13
15A
10
27
18
31
29
28
13A
13B

DEVICE FOR FORMING HANGWIRES

BACKGROUND OF THE INVENTION

Suspended acoustical ceilings are widely used. Ceilings of this type utilize panels marginally supported by a grid system the components of which are typically held suspended by means of hangwires anchored to overhead structure.

Hangwires of the type with which the present invention is concerned, are formed from lengths of wire bent in a manner providing a pair of arms substantially parallel which are typically of different lengths thus establishing a J-shaped preform. One wall of an L-shaped fastener has a hole through which one arm of the preform extends and its other wall carries a fastening element to be anchored in overhead structures. Two arms are twisted together to complete the hangwire with the fastener held loosely in the closed loop formed as a result of the twisting. Each component of the grid system has a lengthwise series of holes through which the longer arms of the hangwires are caught and secured to level and support the grid components in a wanted spaced relation to the overhead structure.

As the wire used to form the hangwires, while bendable, is rather stiff, a device is used to expedite the on-the-job production of the many hangwires each ceiling installation requires. One such device has a U-shaped mount with its closed end to be anchored by screws to a suitable work station. The shank of a hook exposed on the inner surface of one vertical wall constitutes a shaft which extends through and is rotatably held by that wall with its outwardly exposed end including a crank.

The other wall of the device has an upwardly opening slot in alignment with the shaft and dimensioned to accommodate the two arms of the preform. That wall is also provided with a ledge on its outer surface which underlies the slot. A hold down arm is pivotally connected to said outer surface adjacent one end of the ledge in a position to swing from a vertical position into and out of contact with the ledge.

With the closed end of a preform caught by the hook and with the hold down arm inoperatively positioned relative to the slot, the two arms of the hangwire are placed in the slot. The hold down arm is then swung into its operative position and manually held against the two arms of the preform while the crank is turned until the two wire arms are twisted together to the desired extent to complete the hangwire.

Such a device, while effective in forming hangwires, has objectionable features among which is that the hold down arm does not have a depending inoperative position and, in order to twist the two arms of the preform to the wanted extent, it is necessary to turn the crank through 360° several times. In order to enable wire twisting to be effected without undue effort, the length of the crank arm is greater than the distance between the axis of the shaft and the closed end of the mount so that the mount has to be positioned on a support where the crank can overlie a margin thereof.

THE PRESENT INVENTION

The general objective of the present invention is to provide a device for making hangwires which will facilitate the production thereof.

To attain that objective, the device includes a mount having first and second spaced apart walls. The first wall has a housing for a gear train affording mechanical advantage to the user. The gears have shafts rotatably supported by the housing with the shaft of the first gear of the train extending outwardly and including a crank and the shaft of the last gear extending inwardly and provided with a hook by which the closed end of a preform is caught.

The second wall of the mount, as in the case of the previously described device, has an upwardly opening slot overlying a transverse ledge and in alignment with the axis of the last gear with the slot dimensioned to accommodate the two arms of the preform. A hold down arm, pivotally connected to the second wall adjacent one end of the ledge is free to swing from a depending, inoperative position into an operative position in which the portions of the two arms in the slot are held from turning while the preform arms between the second wall and the hook are being twisted together.

Such a construction is advantageous in that with the mechanical advantage provided by the gear train, the two arms of the preform can be quickly and easily twisted together to complete the hangwire. In the preferred embodiment of the invention, the axes of the first and last gears are vertically aligned. The crank arm is of a length also affording mechanical advantage to the user without being of a length making it necessary for the device to be mounted at a work station with the crank spaced outwardly of an edge thereof.

Another feature of the invention is that the hold down arm has an intermediate inoperative position in which it is releasably held extending upwardly from the second wall but inclined slightly away from the slot in the second wall. To that end, the end of the hold down arm which is pivotally connected to the second wall, has a lengthwise slot through which the connecting pivot extends. In the depending inoperative position of the arm, the pivot is in the upper end of the slot and the arm may be swung into its operative position. This position, however, is its position when the device is not in use. The pivoted end of the arm is so shaped and dimensioned that if the arm, when it is swung upwardly from its depending position, is slid downwardly relative to its pivot, the lower end of the arm seats against the proximate end of the ledge and the arm now extends upwardly and is held inclined by its weight away from the slot to establish the intermediate inoperative position for the arm while hangwires are being made.

Other objectives of the invention and the manner of their attainment will be apparent from the description of its preferred embodiment, the accompanying drawings and the appended claims.

THE PREFERRED EMBODIMENT OF THE INVENTION

Figures 3, 4, 5, 6:
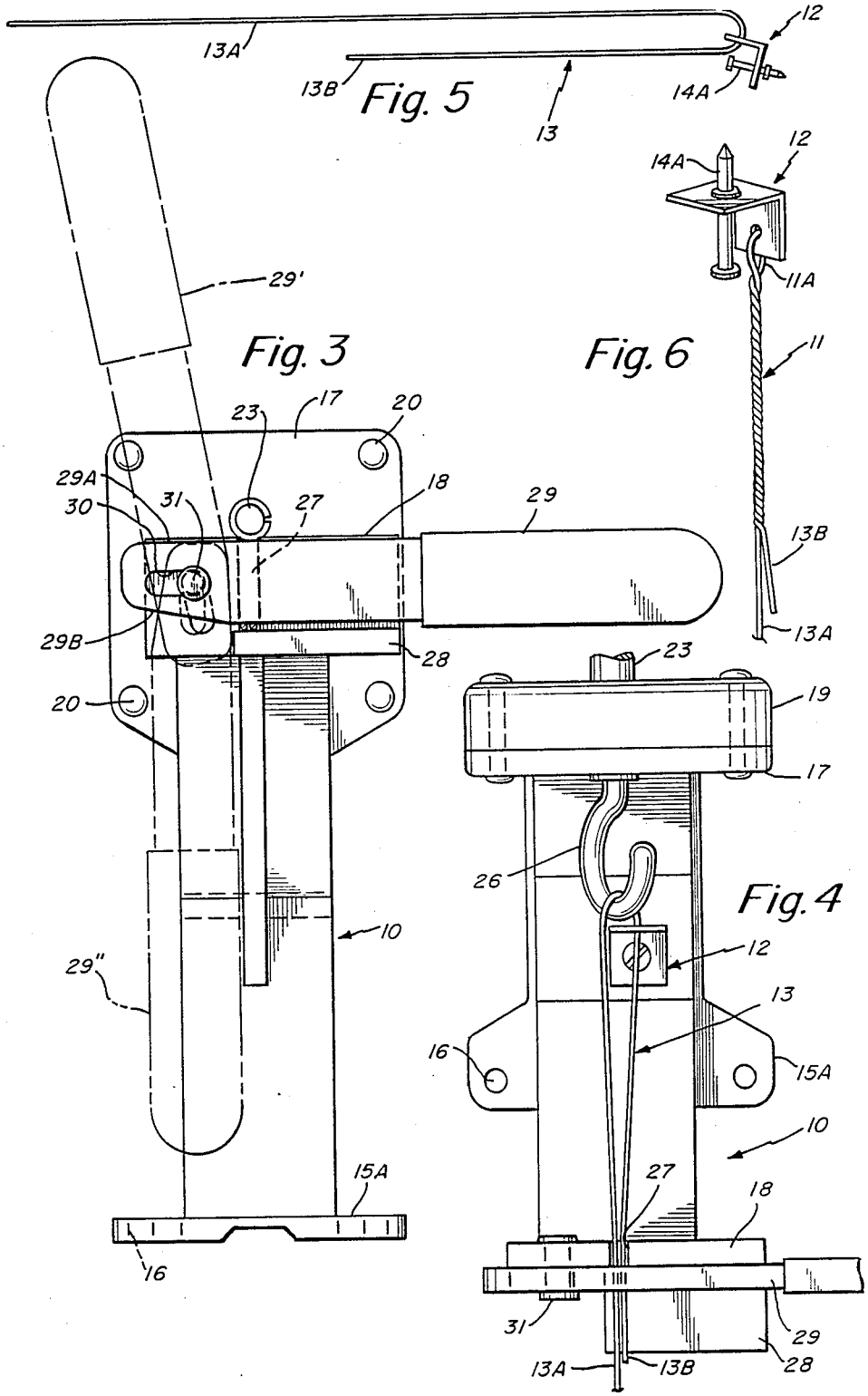
FIG. 3 is a front end view of the device.
FIG. 4 is a top plan view thereof.
FIG. 5 is a plan view of a preform with the fastener of the type including a pin of the type driven with a tool employing pin driving cartridges.
FIG. 6 is a view of the preform of FIG. 5 when its arms are twisted together to form a completed hangwire.

Before describing the device, generally indicated at 10, by which hangwires are formed, reference is made to FIG. 6 wherein a hangwire, generally indicated at 11, is shown with one wall of an L-shaped fastener, generally indicated at 12, held captive in the closed loop 11A of the completed hangwire.

Figure 1:
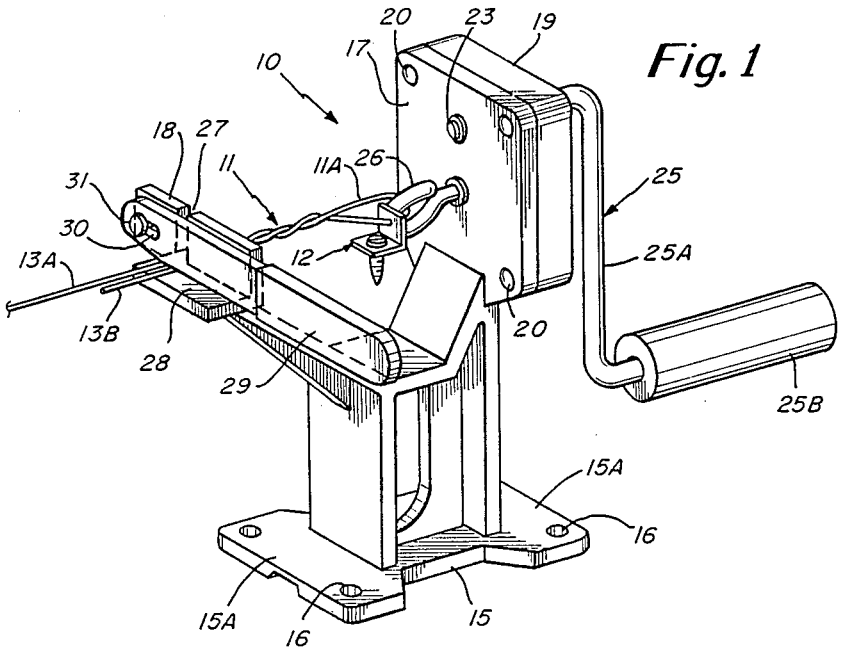
FIG. 1 is a perspective view of the device holding a completed hangwire with the fastener of the type including a screw.
Figure 2:
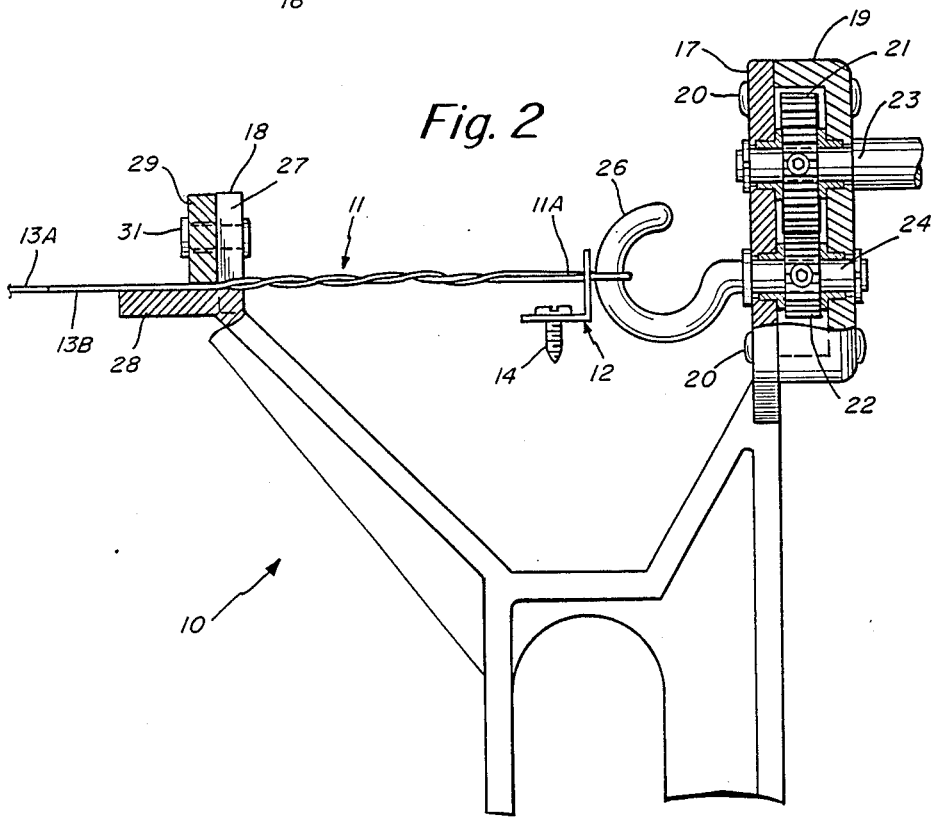
FIG. 2 is a partly sectioned, side view of the device on an increase in scale.

In making a hangwire, a length of wire is bent into a preform, generally indicated at 13 in FIGS. 4 and 5, having one arm 13A longer than its other substantially parallel arm 13B so that the preform is J-shaped with the longer arm 13A of a length enabling it to be passed through a selected hole in a conventional component, now shown, of a grid system by which the panels of the acoustical system are to be supported at a selected distance from overhead structure. In practice, a hangwire 11 is secured to the overhead structure by a screw 14, see FIGS. 1, 2, and 4, held in the other wall of the fastener 12 or by a pin 14A, see FIGS. 5 and 6, held in that fastener wall of a type driven by means of a power actuated tool.

Such a preform is quickly and easily turned into a hangwire using the device 10 which has a base 15 formed with wider ends 15A, provided with holes 16 to enable the device 10 to be securely anchored to a work station by screws.

The base 15 has first and second parallel, vertical walls 17 and 18 which are spaced apart to accommodate the length of the preform that is to be appropriately twisted. A housing 19 is secured as by rivets 20 to the outer surface of the wall 17. Within the housing 19, there is a gear train shown as having but two gears, the gears 21 and 22 which have their respective shafts 23 and 24 rotatably supported by the wall 17 and the outer wall of the housing 19. The axes of the shafts 23 and 24 are vertically aligned and the gears 21 and 22 are dimensioned to establish a desired ratio between them, 2:1 by way of example and not of limitation. The shaft 23 extends through the outer wall of the housing 19 and is provided with a crank, generally indicated at 25. The crank arm 25A is of a length less than the distance between the axis of the shaft 23 and the base 15 to enable the crank to be turned by its handle 25B without contact of the user's hand with the surface on which the device 10 is mounted. The shaft 24 extends through the wall 18 and terminates in a hook 26 by which the closed end of the preform 13 is held.

The wall 18 is provided with an upwardly opening slot 27 in alignment with the axis of the shaft 24 and a shelf or ledge 28 extending across the outer surface of the wall 17 underlies the closed end of the slot 27.

A hold down arm 29 has a slot 30 at one end extending lengthwise of the center line of the arm and accommodating a pivot 31 by which the arm 29 is secured to one margin of the wall 18 adjacent one end of the ledge 28 in a position in which it may be swung from a depending, first inoperative position upwardly over and downwardly against the ledge 28. It will be noted, see FIG. 3, that, in the first inoperative position of the arm 29, the pivot 31 is at the then upper end of the slot 30. In this position of the arm 29, its edges 29A is shown as butted against the proximate end of the ledge 28 and the arm 29 is shown as of a width such that its other edge 29B is substantially in alignment with the adjacent edge of the wall 18. When the arm 29 is in its first, inoperative position and the crank handle 24B in its lowest position, the device is in its best form for packaging or storing.

The arm 29 has a second, inoperative position which is for use during hangwire productions. When the arm 29 is swung upwardly, it may be moved downwardly to seat the pivot 31 in the other end of the slot 30 which end is now uppermost. The slotted end portion of the arm has its edge 29B closer to the slot 30 than the corresponding edge 29A. In the second, inoperative position of the arm 29, the edge 29B now butts against the proximate end of the ledge 28 and the upper portion of the arm 29 tilts away from the slot 27 in the wall so that it is held tilted by its weight in a stable position convenient for the user when hangwires are being made.

From the foregoing, it will be appreciated that to form a hangwire 11 it is only necessary to place the closed end of a preform 13 over the hook 26 and fit the two arms 11A and 11B into the slot 27. With the hold down arm 29 swung into and held in its operative position, the wanted twist, determined by the spacing of the walls 17 and 18 is effected, in practice, by two turns of the crank 25, with the mechanical advantage afforded by the crank and the gear train greatly facilitating production.

I claim:

1. A device for forming a hangwire by twisting together a portion of the shorter arm and the corresponding portion of the longer arm of a J-shaped wire preform having a fastener freely held by the wire in the bend of the preform, said device including a mount provided with first and second parallel vertical walls, the first wall including a housing, a rate reducing gear train within the housing having a first gear and a last gear, the shaft of the first gear extending outwardly with respect to the first wall and provided with a crank and the shaft of the last gear extending inwardly towards the second wall and provided with a hook for receiving and holding the loop established by the bend in the wire of the preform, said second wall having an upwardly opening slot in alignment with the axis of the last gear and dimensioned to accommodate both arms of the preform held by the hook and a transverse ledge underlying the closed end of the slot, said first and second walls spaced apart for the wanted twist length, a hold down arm, and a pivotal connection between one end of the arm and the second wall adjacent one end of the ledge and holding the arm in a position to be swung from an inoperative position in which the slot in the second wall is exposed into an operative position, overlying and against the arm ends within the slot.

2. The device of claim 1 in which the axis of the first gear is above the axis of the last gear and the length of the arm of the crank is less than the distance between the axis of the first gear and the bottom of the mount.

3. The device of claim 2 in which the diameter of the first gear is greater than that of the last gear and the first gear is in mesh with the last gear and the axes of the two gears are vertically aligned.

4. A device for forming a hangwire by twisting together the shorter and the corresponding portion of the longer arm of a J-shaped wire preform having a fastener freely held by the wire in the bend of the preform, said device including a mount provided with first and second spaced apart walls, a hook having a shank, the first wall rotatably supporting the shank of the hook with the hook exposed between the walls and adjacent the first wall, means operable to rotate the hook and connected to the shank thereof, said second wall having an upwardly opening slot in alignment with the axis of the shank and dimensioned to accommodate both arms of the preform when the loop established by the bend is held by the hook, said second end wall also provided with a transverse ledge underlying the closed end of the slot, and spaced from the hook for the wanted twist length, a hold down arm and a pivotal connection between one end of the arm and the second wall adjacent one end of the ledge and holding the arm in a position to be swung from an inoperative position in which the slot is exposed into an operative position overlying the ledge and against the arm ends of the preform within the slot, said pivotal connection characterized by a slot extending lengthwise of one end of the arm and a pivot extending through the slot, and the hold down arm has first and second inoperative positions in the first of which the arm depends vertically and the pivot is in the then upper end of the slot and the slotted end of the arm is uppermost and in the second inoperative arm position the arm extends upwardly, the pivot is in the other end of the slot and an edge of the slotted end is seated against the proximate end of the ledge and the arm is inclined away from the vertical and from the slot in the second wall.

5. The device of claim 4 in which the slot in the hold down arm is in alignment with the center line thereof, one side margin of the slotted end portion of the arm is closer to said lengthwise slot than the opposite side margin, in the depending position of the arm, said opposite side margin butts against the proximate end of the ledge to establish said first inoperative position and in the second inoperative position, said one side margin butts against said ledge end.

* * * * *